US007114557B2

(12) United States Patent
Cudmore et al.

(10) Patent No.: US 7,114,557 B2
(45) Date of Patent: Oct. 3, 2006

(54) SYSTEM AND METHOD FOR OPTIMIZING PRODUCTION IN AN ARTIFICIALLY LIFTED WELL

(75) Inventors: Julian R. Cudmore, Inverurie (GB); Julian B. Haskell, Peterculter (GB); Francis X. T. Miranda, Cults (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 263 days.

(21) Appl. No.: 10/770,918

(22) Filed: Feb. 3, 2004

(65) Prior Publication Data

US 2005/0173114 A1 Aug. 11, 2005

(51) Int. Cl.
*E21B 43/00* (2006.01)

(52) U.S. Cl. ..... 166/52; 166/66.4; 175/45

(58) Field of Classification Search ..... 166/53, 166/72, 66.4; 702/45
See application file for complete search history.

(56) References Cited

U.S. PATENT DOCUMENTS

| | | | | |
|---|---|---|---|---|
| 5,868,201 | A * | 2/1999 | Bussear et al. | 166/53 |
| 6,012,015 | A * | 1/2000 | Tubel | 702/6 |
| 6,041,856 | A | 3/2000 | Thrasher et al. | |
| 6,585,041 | B1 * | 7/2003 | Crossley | 166/53 |
| 6,616,413 | B1 * | 9/2003 | Humpheries | 417/44.1 |
| 6,873,267 | B1 * | 3/2005 | Tubel et al. | 340/853.3 |
| 2002/0074118 | A1 | 6/2002 | Fisher | |
| 2003/0015320 | A1 | 1/2003 | Crossley | |
| 2003/0047308 | A1 | 3/2003 | Hirsch et al. | |
| 2003/0127223 | A1 | 7/2003 | Branstetter et al. | |
| 2005/0173114 | A1 * | 8/2005 | Cudmore et al. | 166/250.15 |

OTHER PUBLICATIONS

R. Stinson, "The Use of Systems Analysis in the Design of a Gas-Lift System", SPE 17584, Nov. 1, 1988, 6 pp., Tianjin, China.
W.J.G.J Der Kinderen, et al., "Real-Time Artificial Lift Optimization", SPE 49463, Oct. 11, 1998, 10 pp., Abu Dhabi, U.A.E.
Y.C. Chia, et al., "Gas Lift Optimization Efforts and Challenges", SPE 57313, Oct. 25, 1999, 9 pp., Kuala Lumpur, Malaysia.
M.L. Litvak, et al., "Prudhoe Bay E-Field Production Optimization System Based on Integrated Reservoir and Facility Simulation", SPE 77643, Sep. 29, 2002, 11 pp., San Antonio, Texas, U.S.A.
P. Wang, et al., "Optimization of Production Operations in Petroleum Fields", SPE 77658, Sep. 29, 2002, 12 pp., San Antonio, Texas, U.S.A.
A.L. Podio, et al., "Advances in Surface Measurements for Optimization of Artificial Lift Operations", SPE 77895, Oct. 8, 2002, 11 pp., Melbourne, Australia.
D. Reeves, et al., "Gas Lift Automation: Real Time Data to Desktop for Optimizing an Offshore GOM Platform", SPE 84166, Oct. 5, 2003, 13 pp., Denver, Colorado, U.S.A.

(Continued)

*Primary Examiner*—Frank Tsay
(74) *Attorney, Agent, or Firm*—Robert A. Van Someren; Wayne I. Kanak

(57) ABSTRACT

A system and method is provided for optimizing production from a well. A plurality of sensors are positioned to sense a variety of production related parameters. The sensed parameters are applied to a wellbore model and validated. Discrepancies between calculated parameters in the wellbore model and results based on sensed parameters indicate potential problem areas detrimentally affecting production.

45 Claims, 11 Drawing Sheets

OTHER PUBLICATIONS

BioComp Systems, Inc., "IntelliDynamics Gas Lift Optimization", Jul. 31, 2003, 2 pp.
eProduction Solutions, "Gas Lift Optimization Solution", Jan. 30, 2004, 7 pp.
JPT Online, "Gas Lift Automation: Real-Time Data to Desktop", Nov. 2003, 4 pp.
Winglue, "Gas-Lift Surveillance Program", no date, 2pp.
Promore, A Core Laboratories Company, "Gas Lift Remote Monitoring and Control System", no date, 1 p.
A.R. Almeida, et al., "Continuous gas lift performance analysis", World Oil, Sep. 1998, 6 pp.
A.A Hady, "The Use of a Multiphase Flow Meter to Optimize Gas Lift Well Operations", International Business Communications, Mar. 18, 1998, 7 pp.
L. Hester, "Advances In Automation Improve Gas Lift Oil Production", Emerson Process Management, Feb. 27, 2003. 6 pp.

* cited by examiner

1. GOR VS. PRESSURE
2. Bo VS. PRESSURE
3. VISCOSITY VS. PRESSURE

SYSTEM AND METHOD FOR OPTIMIZING PRODUCTION IN AN ARTIFICIALLY LIFTED WELL

BACKGROUND OF THE INVENTION

1. Field of the Invention

The present invention relates to artificially lifted oil and gas wells, and in particular to such wells employing electric submersible pumps.

2. Description of Related Art

In many artificially lifted wells, there is potential for significantly improved operation and increased production. There are a variety of mechanisms for artificially lifting fluid from a reservoir, including electric submersible pumping systems and gas lift systems. In using any of these artificial lift systems, a variety of mechanical and systemic components can limit optimization of system usage. For example, artificial lift system components may be blocked, damaged, improperly sized, operated at less than optimal rates, or otherwise present limitations on gaining optimal use of the overall system.

Attempts have been made to detect certain specific problems. However, comprehensive analysis of the well and/or system components has proved to be difficult once the system is set downhole and placed into operation.

BRIEF SUMMARY OF THE INVENTION

In general, the present invention provides a method and system of optimizing production in a well. An artificial lift system, such as an electric submersible pumping system, is operated in a wellbore. During operation, a plurality of production parameters are monitored at a surface location. Simultaneously, a plurality of downhole parameters are monitored in the wellbore. The production parameters and downhole parameters are evaluated according to an optimization model to determine if production is optimized. If not, operation of the artificial lift mechanism is adjusted based on evaluation of the various production parameters and downhole parameters.

BRIEF DESCRIPTION OF THE DRAWINGS

Certain embodiments of the invention will hereafter be described with reference to the accompanying drawings, wherein like reference numerals denote like elements, and.

DETAILED DESCRIPTION OF THE INVENTION

In the following description, numerous details are set forth to provide an understanding of the present invention. However, it will be understood by those of ordinary skill in the art that the present invention may be practiced without these details and that numerous variations or modifications from the described embodiments may be possible.

The present invention generally relates to a system and method for optimizing the use of an artificial lift system, such as an electric submersible pumping system. The process allows the artificial lift system to be analyzed and diagnosed to provide input for optimizing a well's productivity. However, the optimization criteria may relate to different categories depending on the results of the diagnosis. For example, the optimization may relate to drawdown optimization, run life optimization, design and/or sizing optimization, or efficiency optimization. The optimization of a given well may consider one or more of the above listed criteria as well as other potential criteria.

Figure 1:
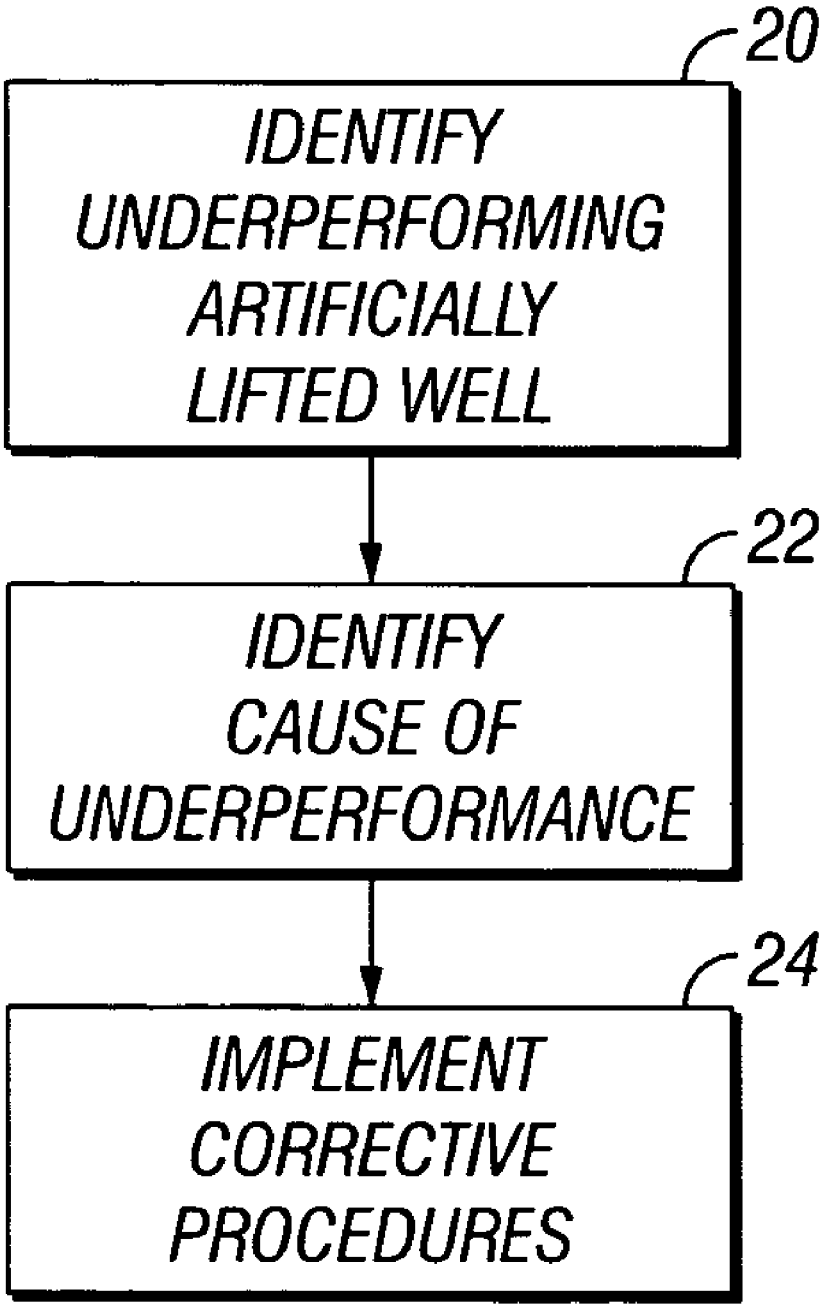
FIG. 1 is a schematic illustration of a methodology for optimizing production in a well, according to an embodiment of the present invention.

A general approach to optimization is set forth in the flowchart of FIG. 1. Initially, underperforming, artificially lifted wells are identified, as set forth in block 20. Upon identifying the underperforming wells, the cause of the underperformance is identified, as illustrated by block 22. Identification of the cause of underperformance enables the implementation of corrective procedures, as illustrated in block 24. Effectively, a cause or problem is identified and an effect or correction is undertaken to optimize performance. Depending on the environment and the specific equipment used, the causes and the selected effects, i.e., corrective actions, may vary as discussed more fully below.

Figure 2:
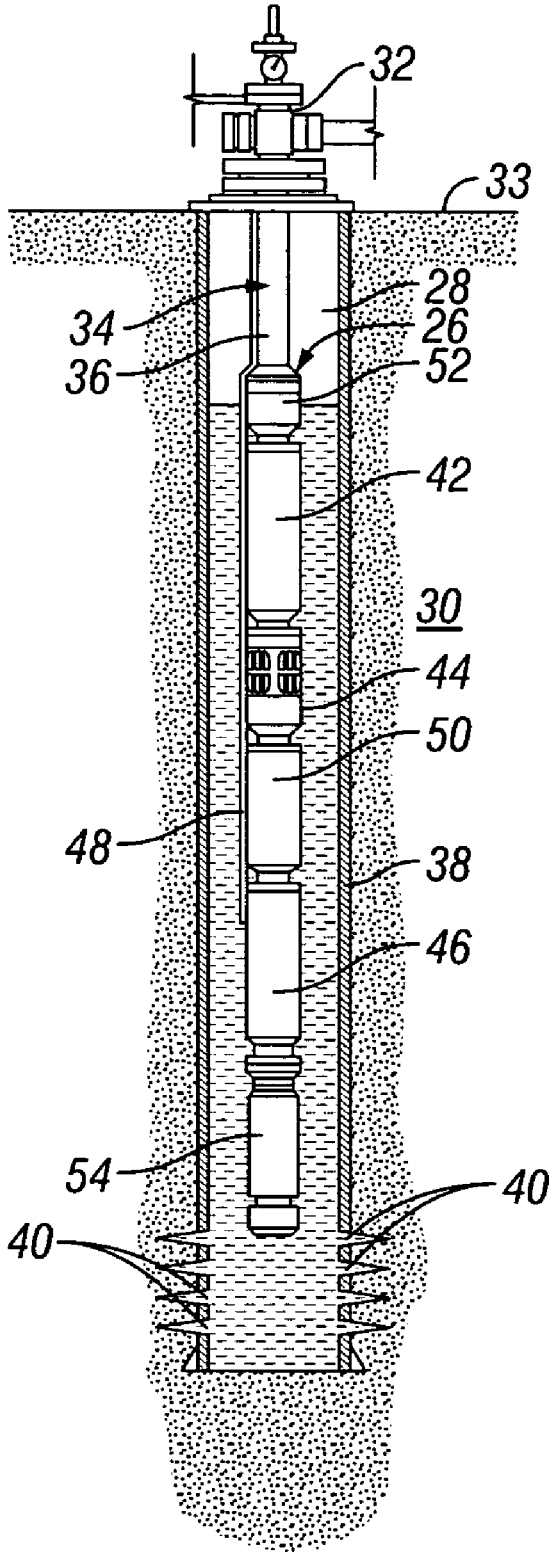
FIG. 2 is an elevation view of an electric submersible pumping system utilized in a well to lift fluids to a surface location, according to an embodiment of the present invention.

Although this general approach can be applied to a variety of artificially lifted wells, the present description will primarily be related to the optimization of a well in which an electric submersible pumping system is used to artificially lift the well fluid. In FIG. 2, an embodiment of an electric submersible pumping system 26 is illustrated. In this embodiment, pumping system 26 is disposed in a wellbore 28 drilled or otherwise formed in a geological formation 30. Electric submersible pumping system 26 is suspended below a wellhead 32 disposed, for example, at a surface 33 of the earth. Pumping system 26 is suspended by a deployment system 34, such as production tubing, coiled tubing, or other deployment system. In the embodiment illustrated, deployment system 34 comprises a tubing 36 through which well fluid is produced to wellhead 32.

As illustrated, wellbore 28 is lined with a wellbore casing 38 having perforations 40 through which fluid flows between formation 30 and wellbore 28. For example, a hydrocarbon-based fluid may flow from formation 30 through perforations 40 and into wellbore 28 adjacent electric submersible pumping system 26. Upon entering wellbore 28, pumping system 26 is able to produce the fluid upwardly through tubing 36 to wellhead 32 and on to a desired collection point.

Although electric submersible pumping system 26 may comprise a wide variety of components, the example in FIG. 2 is illustrated as having a submersible pump 42, a pump intake 44, and an electric motor 46 that powers submersible pump 32. Motor 46 receives electrical power via a power cable 48 and is protected from deleterious wellbore fluid by a motor protector 50. In addition, pumping system 26 may comprise other components including a connector 52 for connecting the components to deployment system 34. Another illustrated component is a sensor unit 54 utilized in sensing a variety of wellbore parameters. It should be noted, however, that a variety of sensor systems deployed along electric submersible pumping system 26, casing 38, or other regions of the wellbore can be utilized to obtain data as described more fully below. Furthermore, a variety of sensor systems can be used at surface 33 to obtain desired data helpful in the process of well optimization.

One example of methodology for optimizing production in a well can be described with reference to the illustrated flowchart of FIG. 3. Initially, the candidate wells are selected based on an indication of underperformance (block 56). In the selected well or wells, data is acquired to gauge the performance of the artificial lift system, e.g. electric submersible pumping system 26 (block 58). (In this example, the data measurements are synchronized and taken in real-time to substantially improve the accuracy and comprehensiveness of the "operational picture" used in analyzing potential problems that contribute to underperformance.) Subsequently, the well is modeled based on known parameters related to the well and the electric submersible pumping system. The modeled well is matched to measured data, as illustrated in block 60. The data is then validated (block 62). Upon validation, a diagnosis of the artificial lift system can be made to determine whether the well is actually underperforming and, if so, the conditions contributing to the underperformance (block 64). Diagnosis of the system enables the implementation of changes, such as providing new settings with respect to operation of the electric submersible pumping system 26 (block 66).

Figure 4:
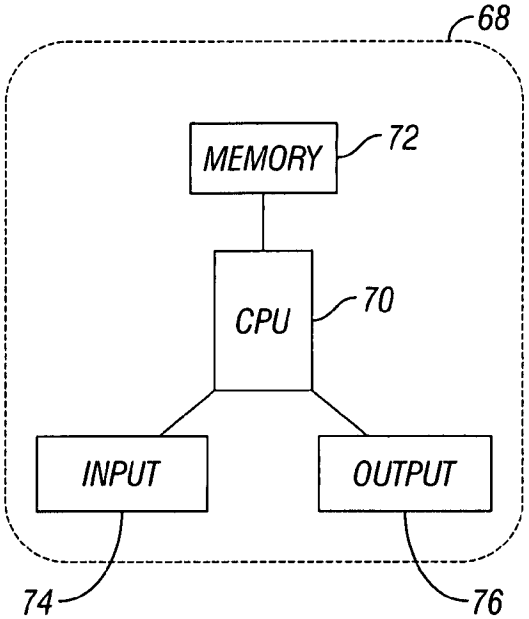
FIG. 4 is a diagramatic illustration of an embodiment of a control system that can be used to automatically carry out the methodology or portions of the methodology illustrated in FIG. 3.
Figure 3:
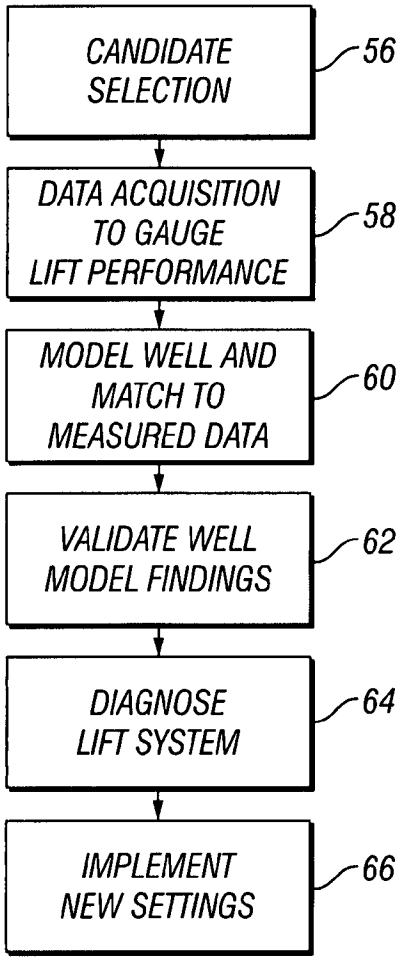
FIG. 3 is a flowchart representing a method of selecting and optimizing production in a well, according to an embodiment of the present invention.

Some or all of the methodology outlined with reference to FIG. 3 is automated via a processing system 68, as diagramatically illustrated in FIG. 4. Processing system 68 may be a computer-based system having a central processing unit (CPU) 70. CPU 70 is operatively coupled to a memory 72, as well as an input device 74 and an output device 76. Input device 74 may comprise a variety of devices, such as a keyboard, mouse, voice-recognition unit, touchscreen, other input devices, or combinations of such devices. Output device 76 may comprise a visual and/or audio output device, such as a monitor having a graphical user interface. Additionally, the processing may be done on a single device or multiple devices at the well location, away from the well location, or with some devices located at the well and other devices located remotely.

Processing system 68 can be used, for example, to input parameters regarding candidate selection, to receive data during the data acquisition phase, to model the well, and to validate well-related data. Diagnosis of the artificial lift system, as well as implementation of new settings, can also be automatically controlled by a processing system, such as system 68. However, it should be recognized that the design and implementation of processing system 68 can vary substantially from one application to another, and the desired interaction between system 68 and an optimization technician may vary based on design considerations and application constraints.

As briefly described with reference to FIG. 3, candidate wells are initially selected. In, for example, oilfields with high populations of electric submersible pumping systems, it is important that likely candidates for optimization are filtered from wells that are already running at optimum conditions and at optimum rates. In one approach, candidate selection may be used to filter out wells according to priority of oil production gain to aid in attaining maximum success in a minimum timeframe. The recognition of sub-optimally lifted wells relative to other wells in the field is not a straightforward task and requires evaluation of various data and information.

The ability to determine likely candidates for optimization often relies on obtaining accurate data related to the subject wells. For example, it can be useful to observe a data trend to determine the consistency and hence the accuracy of the data relied on in determining likely candidates for optimization.

Figure 5:
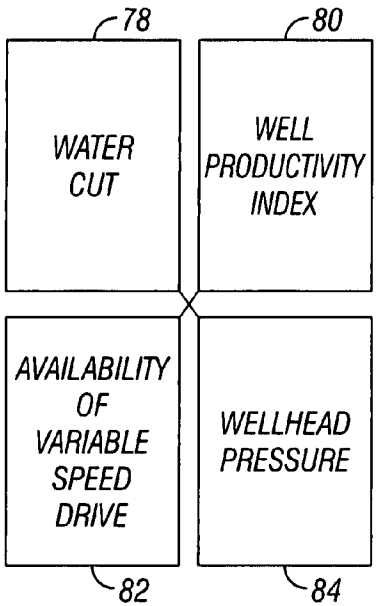
FIG. 5 is an illustration of parameters utilized in candidate selection.

Also, it is important to determine which parameters are the key parameters that will aid in selecting likely candidates. With respect to electric submersible pumping systems, examples of potential key parameters are illustrated in the diagram of FIG. 5. Other key parameters are possible, but the examples illustrated are water cut 78, well productivity index 80, availability of a variable speed drive 82, and wellhead pressure 84. In this scenario, higher levels of water cut indicate a lower potential for gains in oil production. However, a higher productivity index indicates a greater potential for gains in oil production by small operational changes. The availability of a variable speed drive on the well enables a frequency change that can significantly affect the production rate. Furthermore, if a high wellhead pressure is indicated, reduction in that pressure often can cause substantial gains in oil production.

Upon selecting a candidate well, data is acquired to gauge the performance of the artificial lift system. Typically, data is acquired by a variety of sensors that may comprise, for example, distributed temperature sensors and pressure gauges. Also, it can be beneficial to utilize sensor systems able to provide real-time streaming data. Trended data with common time and date facilitates the selection of points of interest from trend lines, thereby providing more accurate "snap shots" of well operation to aid in analysis.

Figure 6:
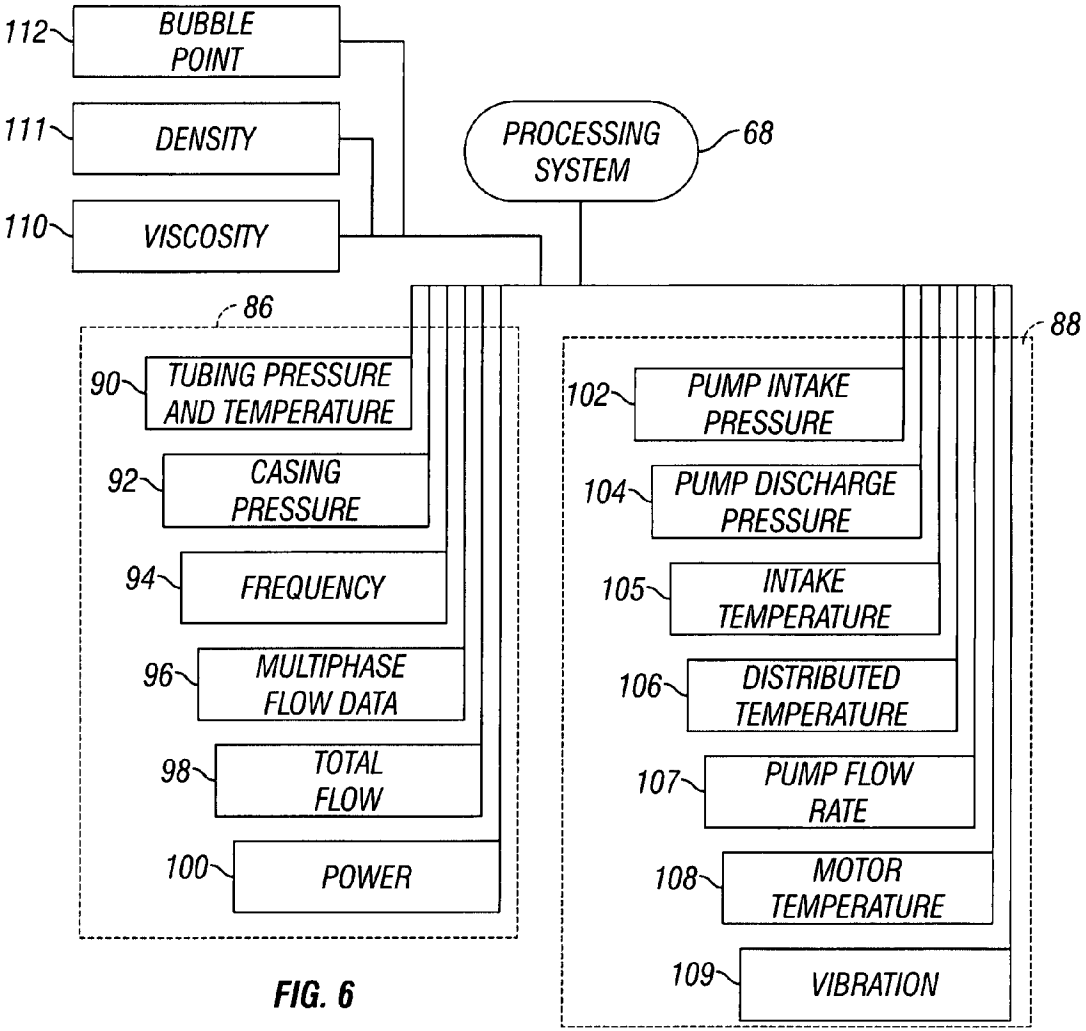
FIG. 6 is an illustration of a system that can be used to acquire data for processing according to the well optimization methodology illustrated in FIG. 3.

In FIG. 6, an embodiment of a sensor system used to facilitate optimization of an electric submersible pump is illustrated. The various sensors may be coupled to processing system 68, which is able to assimilate the data and display relevant information to a technician and/or utilize the data in performing analyses on the well. Although a variety of parameters may be used in analysis of a given well, FIG. 6 illustrates examples of surface measurements 86 and downhole measurements 88 that can be obtained in real-time and delivered to processing system 68 for analysis. Examples of surface sensors and/or sensed parameters include tubing pressure and temperature sensors 90, casing pressure sensors 92, frequency sensors 94 for sensing power signal frequency, multiphase flow data sensors 96, total flow sensors 98, and power sensors 100. Examples of downhole sensors and/or sensed parameters include pump intake pressure sensors 102, pump discharge pressure sensors 104, intake temperature sensors 105, distributed temperature sensors 106, pump flow rate sensors 107, motor temperature sensors 108, and vibration sensors 109. However, a variety of other sensors designed to sense additional parameters can be added. For example, some applications can be designed to utilize viscosity sensors 110 for sensing fluid viscosity, density sensors 111, and sensors 112 for determining bubble point incipience. Additionally, it may not be necessary to utilize all of the sensors illustrated. For example, in some applications, the methodology discussed herein may be carried out with a unique subset of the illustrated sensors, such as sensors 90, 92, 94, 96, 102, 104, and 106.

Figure 7:
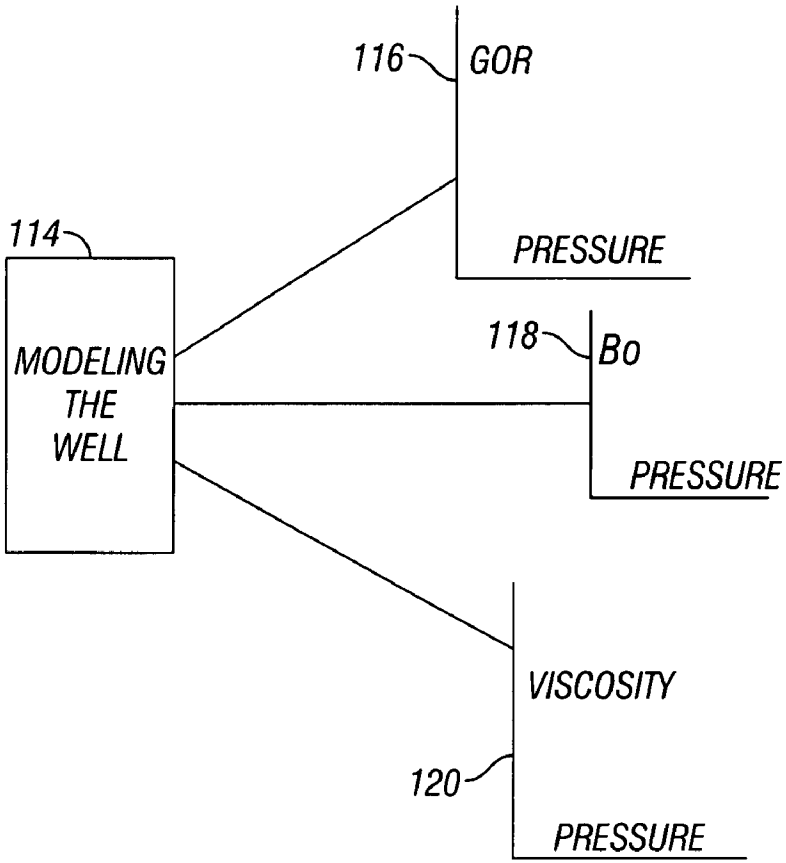
FIG. 7 is an illustration of one embodiment of a system and approach that can be used in modeling a well.

In addition to acquiring data, the subject well is modeled. However, modeling of the well will vary depending on the environment in which the wellbore is drilled, formation parameters, and type and componentry of the artificial lift system. Proper modeling of the well enables contrasting measured data, derived from the sensed parameters, with an optimization model to facilitate analysis of the data and, ultimately, optimization of the well. As illustrated in FIG. 7, a well modeling program 114 can be utilized on processing system 68 to assimilate measured or input data for display to a technician on output device 76 or for further processing during data validation and diagnosis. By way of example, modeling program 114 can compare measured data, based on the sensed parameters, to corresponding calculated model values and provide graphical comparisons, e.g. graphs 116 (Gas/Oil Ratio versus Pressure), 118 (Formation Volume Factor—Oil versus Pressure), and 120 (Viscosity versus Pressure) illustrated in FIG. 7. However, the specific data collected and the modeling desired can vary significantly depending on the particular application. An example of a software program that can be used with processing system 68 for modeling the well is a software product called ALXP (Artificial Lift Extended Production) available from Schlumberger Technology Corporation of Sugar Land, Tex., USA. ALXP can be used to model wells in which electric submersible pumping systems are deployed and also to assist in validation and analysis of data.

Figure 8:
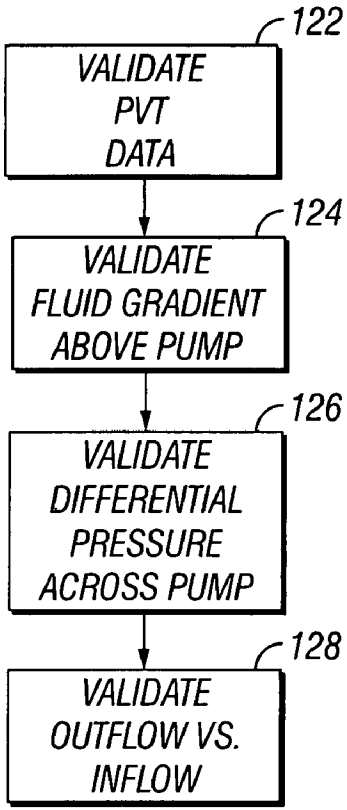
FIG. 8 is a flowchart representing an approach to validating acquired data.

As briefly discussed above, real-time collection of data from a wide variety of sensors and the assimilation of that data for comparison to a predetermined model lays important groundwork for optimization of a given well. However, the efficacy of corrective action is improved by validating the actual data collected as well as the use of that data in modeling the well. In the electric submersible pumping system example described herein, proper optimization can be influenced by PVT (pressure, volume, and temperature) data, the fluid gradient above the pump 42, the differential pressure across the pump 42, and the outflow versus inflow. Accordingly, one approach to validation of this type of system is to validate each of these parameters. As illustrated in FIG. 8, the validation process may comprise validation of PVT data (block 122), validation of the fluid gradient above the pump (block 124), validation of the differential pressure across the pump (block 126), and validation of the outflow versus inflow (block 128).

Figure 9:
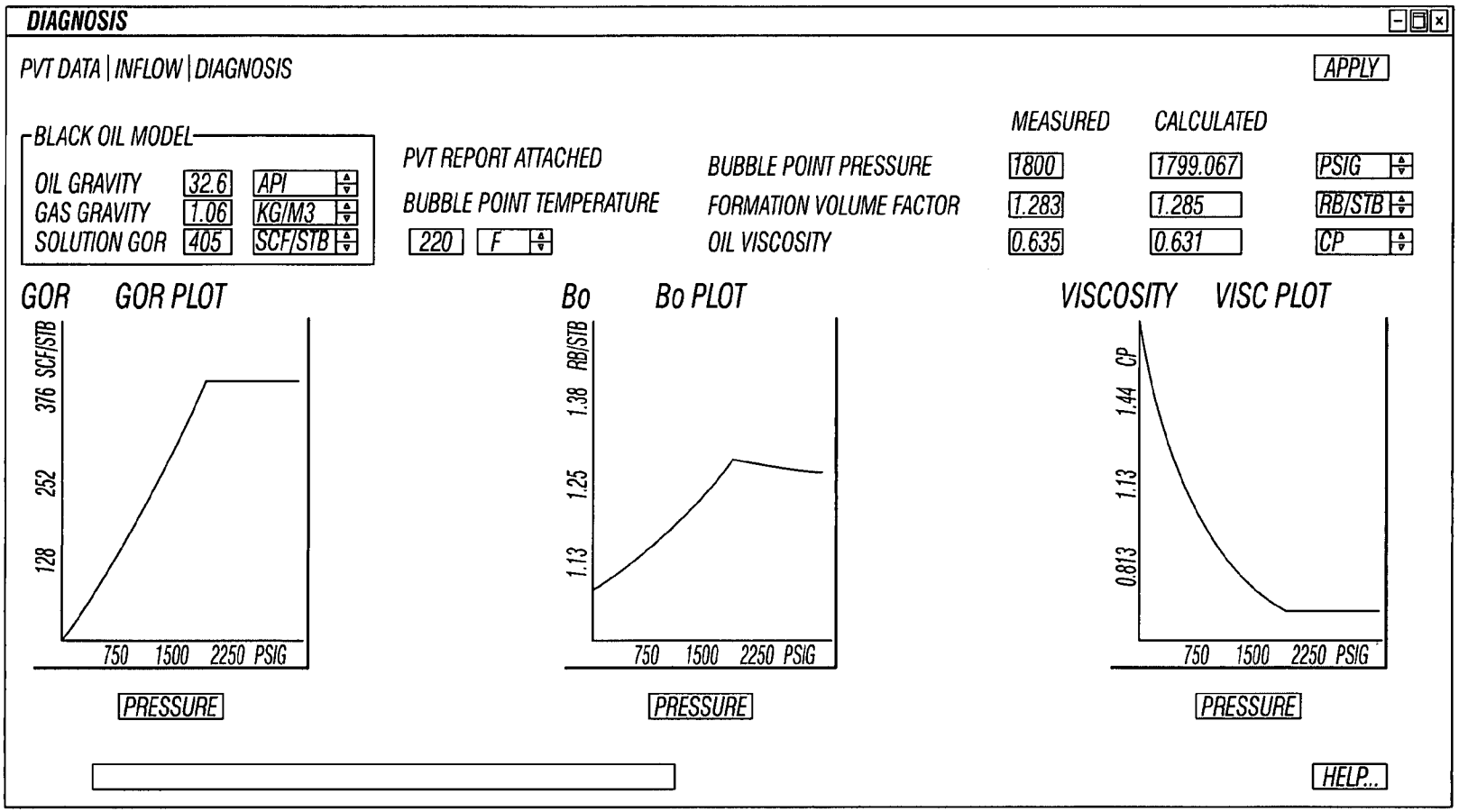
FIG. 9 illustrates an example of a graphical user interface that can be used to facilitate validation of data.

PVT data can be validated in a variety of ways depending on the specific PVT data analyzed. For example, the actual Gas/Oil Ratio (GOR), Formation Volume Factor—Oil (Bo), and oil viscosity data often can be obtained from the operator of the well. Other data also can be determined or correlated. For example, a standing correlation can be used to determine a calculated value of bubble point pressure and formation volume factor. A Beggs correlation can be used to calculate oil viscosity. The predetermined or calculated values are used to construct the model of the well against which the measured PVT data can be compared for validation. As illustrated in FIG. 9, processing system 68 and output device 76 may be used to display, for example, correlation plots comparing calculated or model values to measured values to emphasize any discrepancies.

Figure 10:
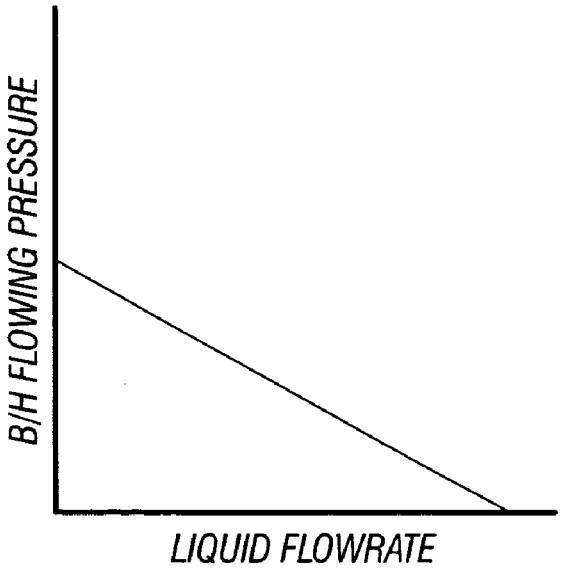
FIG. 10 is a graphical representation of inflow performance that can be used in the validation process.

Accurate inflow data can also be important in validating a variety of flow-related parameters. Inflow Performance Relationship (IPR) calculations can be made according to a variety of methods. For example, the well operator's inflow values can be used; a straight line Productivity Index (PI) can be calculated from given test flow rates and bottom hole flowing pressures; a straight line IPR can be determined from a given PI and static reservoir pressure or calculated from test flow rates and test pressures; or a Vogel or composite IPR plot can be derived from given test flow rates, bottom hole flowing pressures and a Vogel coefficient. The results may be graphically displayed on output device 76. One example of such graphical display is provided in FIG. 10 in which a straight line IPR is illustrated in which liquid flow rate is correlated with bottom hole flowing pressure.

Figure 11:
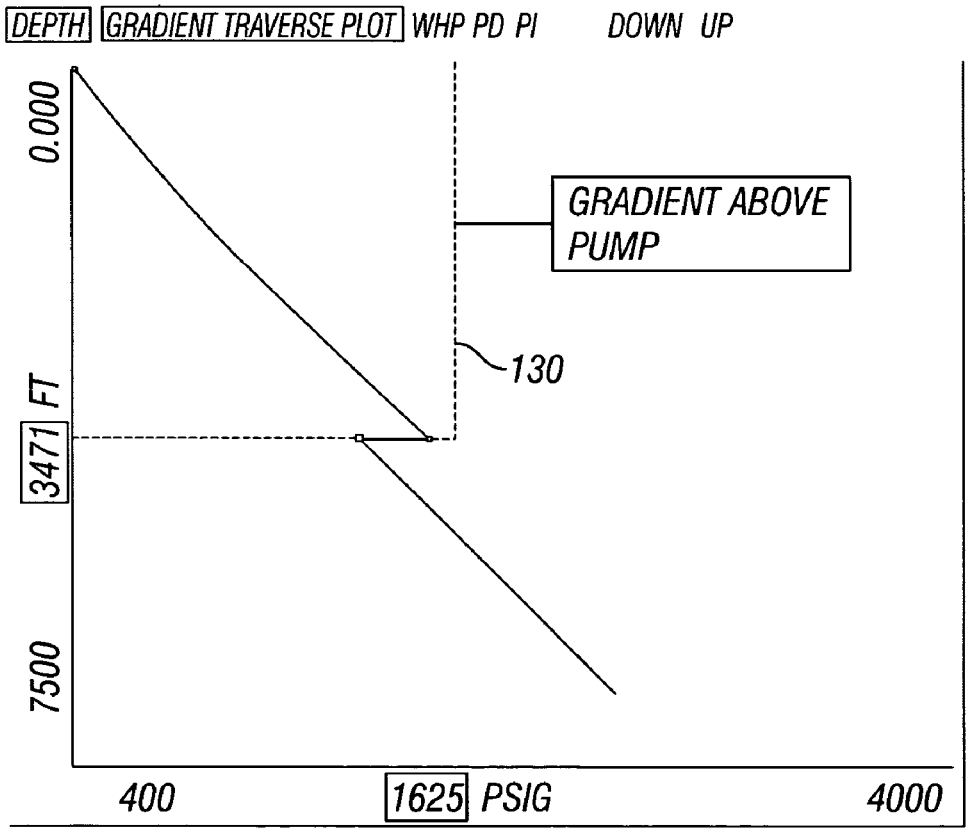
FIG. 11 is a graphical representation of above the pump calculations used in the validation process.

Validation of the fluid gradient above the pump uses "above pump" calculations. A useful equation is: pump discharge pressure=wellhead pressure (WHP)+delta P tubing (density)+delta P tubing (friction). An "above the pump" calculation plots the fluid gradient from the measured wellhead pressure to the pump discharge pressure. If a pressure point at the pump discharge is known, this value can be used to calibrate or match the gradient to enable validation of information on fluid density (95 percent of the tubing pressure drop). If the discharge pressure is not available, then accurate measurement of water cut, GOR, and gross flow rate is required. Validation of the fluid gradient, as illustrated graphically in FIG. 11, is important because subsequent steps in the validation process rely on an accurate determination of the specific gravity of the pumped fluid. Referring generally to FIG. 11, the above the pump fluid gradient is illustrated in box 130.

To match the fluid gradient from wellhead pressure to pump discharge pressure, the fluid properties affecting the density of the fluid can be adjusted. An appropriate underlying assumption is that at least 95 percent of the tubing pressure loss is comprised of the pressure loss due to fluid density and that pressure losses due to friction are relatively small. It is therefore possible to calibrate the fluid gradient to match the measured discharge pressure by adjusting the data that affects the density of the fluid. This can be accomplished by adjusting, for example, water cut and/or total GOR values. A match occurs when the calculated pump discharge pressure matches the measured pump discharge pressure.

Figure 12:
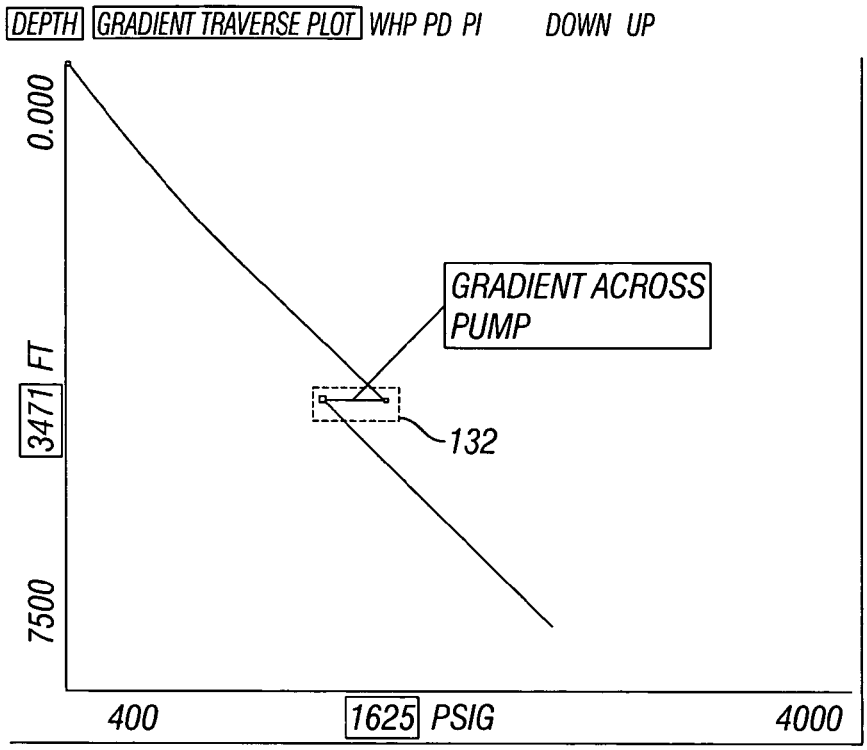
FIG. 12 is a graphical representation of across the pump calculations used in the validation process.

Subsequently, "across the pump" calculations can be made. A useful equation is: pump intake pressure=pump discharge pressure−pump differential pressure. The pump differential pressure (pounds per square inch) equals head (feet) times specific gravity/2.31. The across the pump calculations determine the pump differential pressure and plot a calculated pump intake pressure from the validated pump discharge pressure. The fluid density (specific gravity), previously validated, enables use of measured data to help validate flow rate information. The flow rate information can later be crosschecked to inflow performance calculations. The gradient across the pump is graphically illustrated in FIG. 12 by block 132.

As described above, the calculated pump flow rate is a function of the differential pressure across the pump and fluid density. The fluid density was previously validated by matching the gradient above the pump, thereby enabling the match of pump differential pressure to intake pressure using flow as the calibrating parameter. It should be noted that this assumes the pump curve has not deteriorated due to viscosity or wear. Further validation of flow can be performed later by crosschecking with inflow.

Additionally, "below the pump" calculations also can be made to further validate measured parameters. A useful equation is: flowing bottom hole pressure (FBHP)=pump intake pressure+casing pressure loss. Another useful equation is: flowing bottom hole pressure=reservoir pressure−(flow/Productivity Index). Using both outflow values (tubing pressure loss, pump, wellhead pressure, etc.) and inflow values (IPR data), the flow rate can further be validated under operating conditions.

Figure 13:
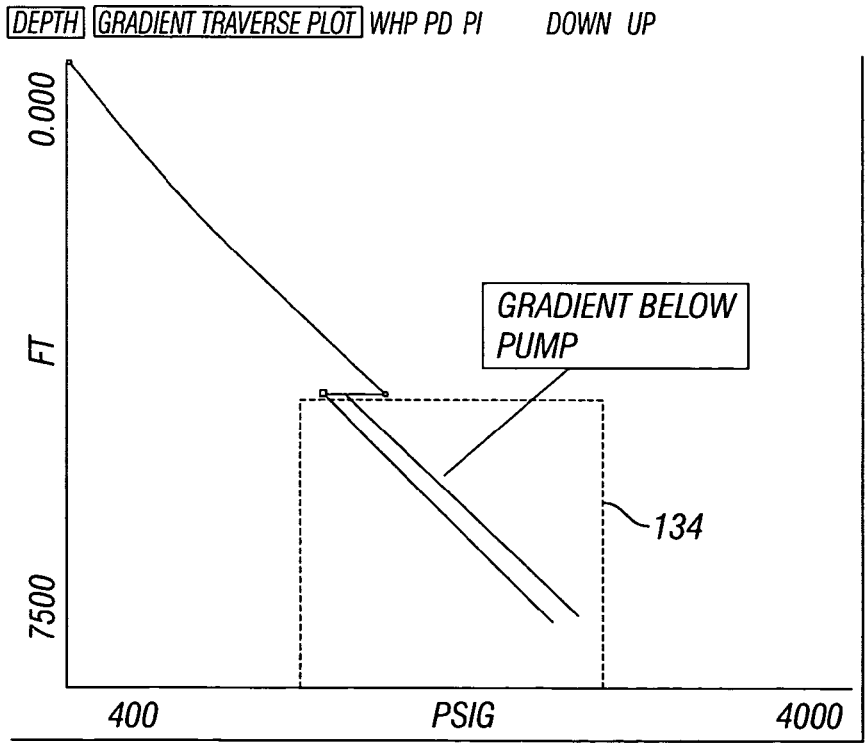
FIG. 13 is a graphical representation of below the pump calculations used in the validation process.

The outflow gradient is finalized using the below the pump calculation which produces the gradient of fluid from the pump intake to the flowing bottom hole pressure at the casing perforations. A "bottoms up" calculation determines the flowing bottom hole pressure from the inflow data and plots a gradient up to the pump intake depth. The below pump plot and bottoms up plot should match to a common intake pressure and bottom hole flowing pressure. A gradient below the pump is a graphically illustrated in FIG. 13 by block 134.

Generally, the same calculations are performed below the pump as performed above the pump. The outflow plots top down, and the inflow (bottoms up) plots from the reservoir pressure to the pump intake. If the measured flow rate, reservoir pressure and productivity index are correct, then the calculated plots should match the measured data.

Figure 14:
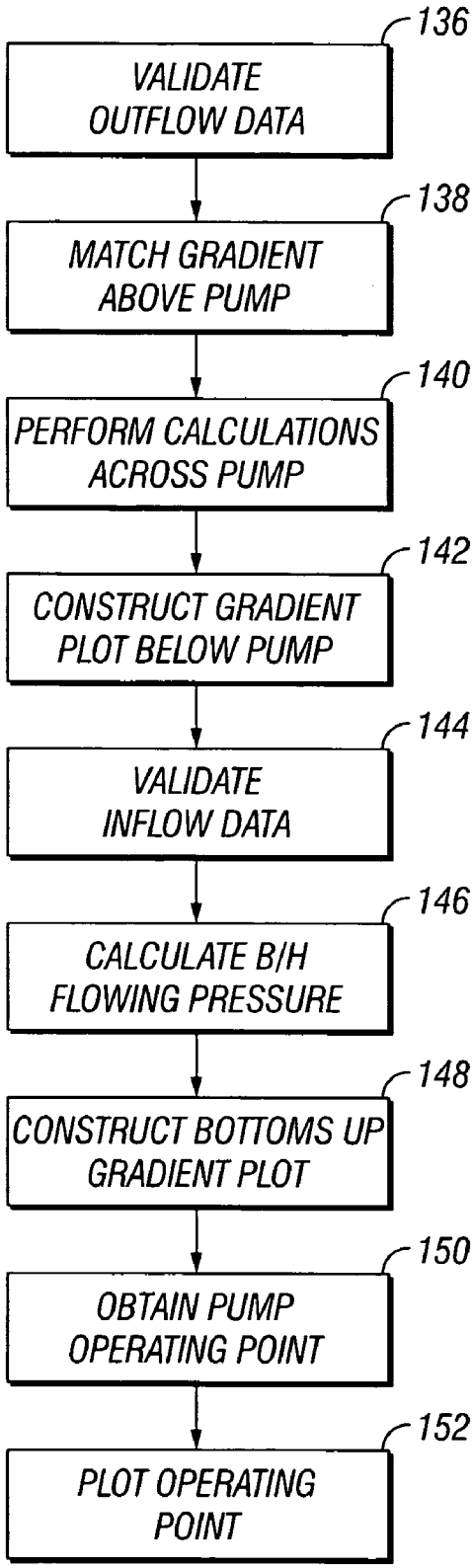
FIG. 14 is a flowchart representing an approach for validating acquired data.

With reference to FIG. 14, an example of a methodology for validating measured data related to an electric submersible pumping system is illustrated. The methodology incorporates many of the steps or approaches discussed above. Initially, outflow data is validated, as indicated by block 136. Validation of outflow data may comprise matching above the pump gradients based on measured and calculated values (block 138). The validation of outflow data may further include performing calculations across the pump (block 140) and constructing gradient plots below the pump (block 142). Subsequently, inflow data is validated, as illustrated by block 144. The validation involves calculating a bottom hole flowing pressure and comparing the calculated value to a measured value (block 146). The validation of inflow data also may comprise utilization of bottoms up gradient plots for comparison of data (block 148). Subsequently, a pump operating point is obtained, as illustrated in block 150. The operating point is plotted for comparison of measured and calculated values (block 152).

Figure 15:
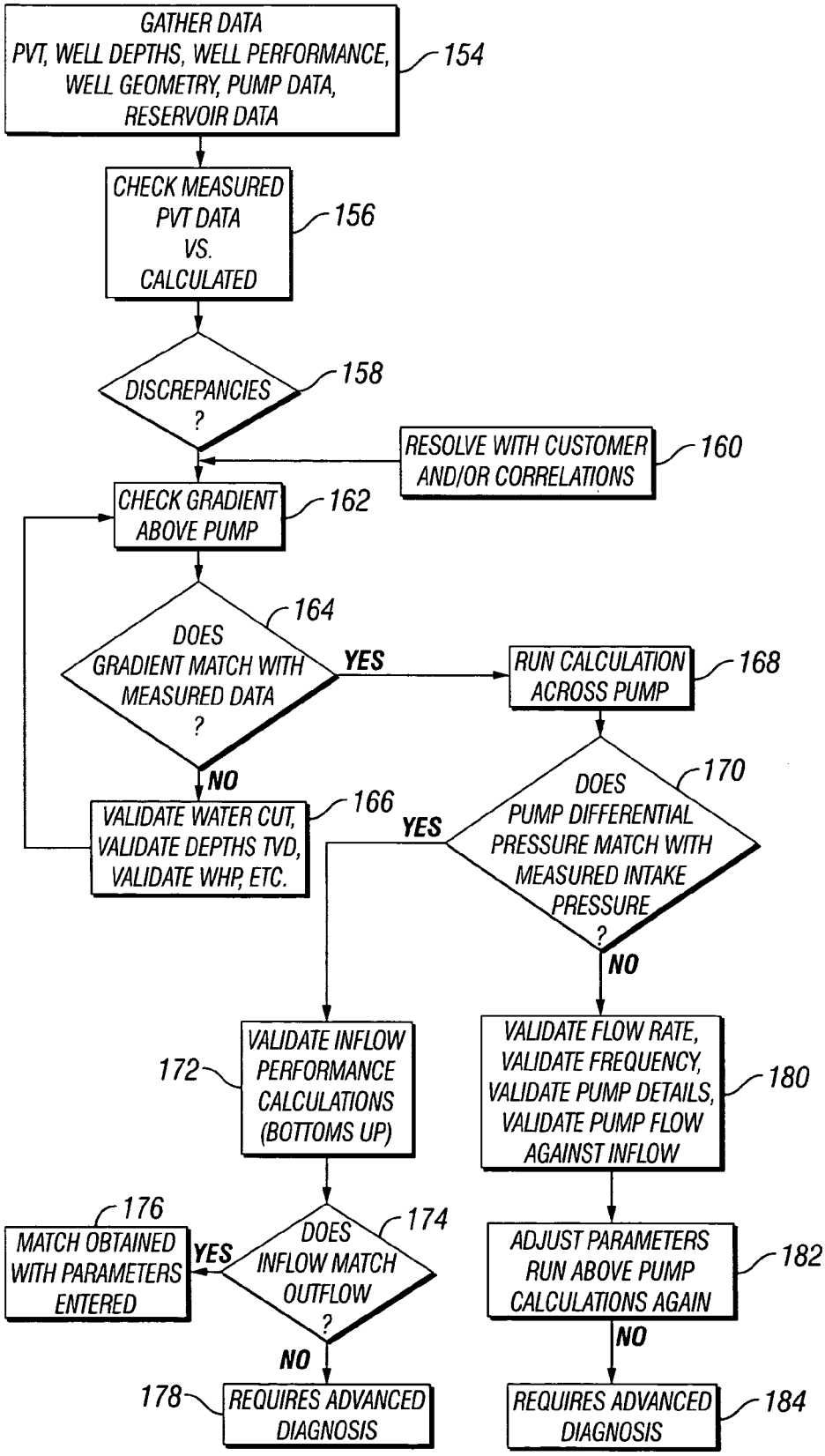
FIG. 15 is a flowchart representing a methodology for diagnosing potential limitations on optimization of system usage.

As described above, calculated values are used to construct a model of optimal well performance that can be contrasted with measured data derived from sensed parameters. This process of validating measured data discloses any discrepancies between model values and measured data. The discrepancies that arise effectively guide the diagnosis of potential problems limiting optimization of the well. The diagnoses can be carried out on processing system 68 to facilitate quick and accurate assessment of potential problems. When using an electric submersible pumping system to lift the fluid, the diagnoses can be performed, for example, according to the flowchart illustrated in FIG. 15.

As illustrated, data is initially gathered regarding a variety of production related parameters, e.g. PVT data, well depths, well performance, well geometry, pump data, reservoir data, and other data, as illustrated in block 154. A subsequent step in the diagnosis is checking measured PVT values against calculated PVT values (block 156). The program checks for any discrepancies (block 158) between the measured data and the calculated values. If a discrepancy exists, an indication of that discrepancy may be displayed at output device 76 for review by a technician, as illustrated in block 160. The discrepancy may be resolved by checking the correlations obtained and/or checking the production related values supplied by the well operator.

Subsequently, the gradient above the pump is checked (block 162) as described above. The calculated gradient is compared to the measured data to determine whether the gradient matches the measured data (block 164). If the gradient does not match the measured data (block 166), various values, such as water cut, depths, wellhead pressure, etc., are checked and the program is returned to step 162 to again check the gradient above the pump. On the other hand, if the gradient above the pump matches measured data, the across the pump calculation is made (block 168) as described above.

Upon running the calculation across the pump, a determination is made as to whether the differential pressure across the pump can be matched with the measured intake pressure, as illustrated in block 170. If the differential pressure matches, then the inflow performance cancellations are validated (block 172), and a determination is made as to whether inflow properly matches outflow (block 174). If yes (block 176), then a match exists between the calculated values and the measured values. If no (block 178), then further diagnoses must be made to determine the source of the discrepancy and the potential problems detracting from optimizing the well potential.

Returning to step 170, if the differential pressure does not match with the measured intake pressure, then various parameters should be checked, as illustrated in block 180. For example, the flow rate, frequency, pump details, pump flow versus inflow, and other parameters should be checked and validated to determine if an error occurred. If adjustments to the parameters are made (block 182), then the above the pump calculations can be run again. Otherwise, further diagnoses must be made (block 184) to determine the source of the discrepancy and the potential problems detracting from optimizing the well potential.

The comparison of calculated values to measured values and discrepancies between those values can provide an indication of specific problems that caused sub-optimal production. The meaning of the data relationships and discrepancies, however, can vary depending on the type of artificial lift system utilized, the components of the artificial lift system, and environmental factors. Additionally, discrepancies can sometimes be addressed by simple operational adjustments, such as adjusting a choke or valve to allow more or less flow, or adjusting the frequency output of a variable speed drive. Other discrepancies may indicate worn components, broken components, blocked components, or other needed remediation. For example, in the system described above in which an electric submersible pumping system is utilized to produce a well fluid, a blocked pump intake is suspected if the following conditions exist:

- a match is not attainable between the measured and calculated intake pressures when performing across the pump calculations (the measured intake pressure will appear higher than the calculated intake pressure);

the bottoms up gradient can be matched to intake pressure; and the actual pump intake pressure is low, but the measured data is higher, assuming the point at which the sensor intake pressure data is measured is upstream of the blockage.

By way of another example, recirculation of fluid in the wellbore, due to, for example, a tubing leak, may be suspected if the following conditions exist:

the calculated inflow can be matched to intake pressure using the given original flow rate measured at the surface;

the above the pump calculations match using given original flow rate measured at the surface; and pump curve calculations show the flow rate must be significantly higher to obtain a match on operating point. However, this higher flow rate produces a higher discharge pressure calculation above the pump.

Figure 16:
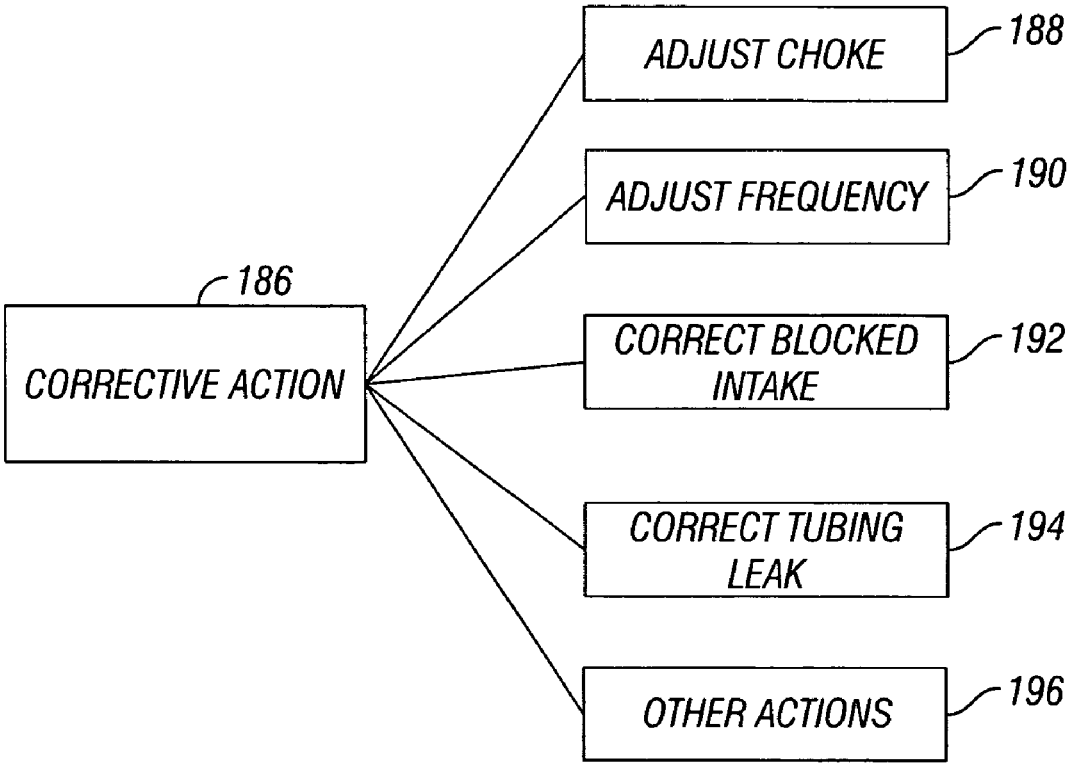
FIG. 16 is a diagram representing a variety of corrective actions that may be applied to optimize production in a well.

Once the diagnosis is completed, appropriate corrective action is made to optimize performance of the well. As illustrated in FIG. 16, a corrective action (block 186) may comprise implementing new settings and/or other corrective actions, as illustrated by action blocks 188, 190, 192, 194, and 196. Depending on design objectives of the overall system, at least some corrective actions can be automated by programming processing system 68 to carry out such corrective action based on results of the well modeling, validation, and diagnoses. For example, if optimization involves adjusting flow rate, appropriate signals can be provided by processing system 68 to, for example, adjust a choke (block 188) or adjust the frequency of a variable speed drive (block 190). Other corrective actions, such as clearing an intake (block 192) or fixing a tubing leak (block 194) may involve substantial component repair or replacement actions that require human intervention.

Although, only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A method of optimizing production in a well, comprising:

operating an artificial lift system in a wellbore;

monitoring a plurality of production parameters at the surface;

monitoring a plurality of downhole parameters in the wellbore;

evaluating measured data derived from the plurality of production parameters and the plurality of downhole parameters according to an optimization model that optimizes at least one function of the measured data; and adjusting operation of the artificial lift system based on the evaluation.

2. The method as recited in claim 1, wherein operating an artificial lift system comprises operating an electric submersible pumping system.

3. The method as recited in claim 1, wherein monitoring the plurality of production parameters comprises measuring a tubing pressure and a tubing temperature.

4. The method recited in claim 1, wherein monitoring the plurality of production parameters comprises measuring a casing pressure.

5. The method as recited in claim 1, wherein monitoring the plurality of production parameters comprises measuring multiphase flow data.

6. The method as recited in claim 1, wherein monitoring the plurality of production parameters comprises measuring a tubing pressure, a tubing temperature, a casing pressure, and multiphase flow data.

7. The method as recited in claim 1, wherein monitoring the plurality of downhole parameters comprises measuring a pump intake pressure.

8. The method as recited in claim 1, wherein monitoring the plurality of downhole parameters comprises measuring a pump discharge pressure.

9. The method as recited in claim 1, wherein monitoring the plurality of downhole parameters comprises measuring an intake temperature.

10. The method as recited in claim 1, wherein monitoring the plurality of downhole parameters comprises measuring a pump intake pressure, a pump discharge pressure and an intake temperature.

11. The method as recited in claim 1, wherein monitoring the plurality of downhole parameters comprises measuring distributed temperature.

12. The method as recited in claim 1, wherein monitoring the plurality of downhole parameters comprises measuring a fluid viscosity.

13. The method as recited in claim 1, wherein monitoring the plurality of downhole parameters comprises measuring a fluid density.

14. The method as recited in claim 1, wherein monitoring the plurality of downhole parameters comprises measuring a bubble point.

15. The method as recited in claim 1, wherein at least one of monitoring a plurality of production parameters and monitoring a plurality of downhole parameters comprises using a multiphase flowmeter.

16. The method as recited in claim 1, wherein the step of evaluating measured data comprises processing the data on a computer.

17. The method as recited in claim 1, wherein the step of adjusting operation of the artificial lift system comprises changing a frequency output of a variable speed drive.

18. The method as recited in claim 1, wherein the step of adjusting operation of the artificial lift system comprises adjusting a choke to change flow rate.

19. The method as recited in claim 1, wherein the step of adjusting operation of the artificial lift system comprises removing a blockage.

20. The method as recited in claim 1, wherein the step of adjusting operation of the artificial lift system comprises repairing a leak.

21. A system for optimizing production in a well, comprising:

an electric submersible pumping system positioned in a well;

a sensor system having sensors positioned in the well and/or at the surface to sense a plurality of production related parameters; and a well modeling module operatively connected to the sensors to receive input from the sensors, wherein the well modeling module is able to contrast model values with measured data based on input from the sensors in a manner indicative of specific problem areas detrimental to optimizing production from the well.

22. The system as recited in claim 21, wherein the production related parameters are sensed in real time.

23. The system as recited in claim 21, further comprising a validation module operatively connected to the well modeling module for validating data used in modeling the well.

24. The system has recited in claim 21, wherein the sensor system comprises sensors positioned to take both downhole measurements and surface measurements.

25. The system as recited in claim 23, wherein the validation module is able to validate pressure, volume, and temperature data.

26. The system as recited in claim 23, wherein the validation module is able to validate an above the pump fluid gradient.

27. The system as recited in claim 23, wherein the validation module is able to validate a differential pressure across the pump.

28. The system as recited in claim 23, wherein the validation module is able to validate an outflow versus an inflow of fluid to the pump.

29. The system as recited in claim 21, wherein the system comprises a variable speed drive, the frequency output of which is adjustable in response to a specific problem area indicated by the well modeling module.

30. The system as recited in claim 21, wherein the system comprises an adjustable choke to change flow rate.

31. A method of diagnosing the operation of an electric submersible pumping system, the system having a pump powered by a submersible motor, sensors for measuring production related data, and a processing system for calculating values of production related data and comparing calculated production related data and measured data, the method comprising:

measuring production related data with the sensors;

comparing calculated pressure, volume, and temperature values with measured pressure, volume, and temperature data;

calculating above the pump gradient values;

comparing calculated above the pump gradient values with measured data;

calculating across the pump values;

comparing calculated across the pump values with measured data; and identifying any discrepancies between calculated values and measured data.

32. The method as recited in claim 31, wherein comparing calculated across the pump values with measured data comprises comparing a differential pressure across the pump and a measured intake pressure.

33. The method as recited in claim 31, further comprising graphically displaying calculated values versus measured data on an output device.

34. The method as recited in claim 31, further comprising making operational adjustments to the electric submersible pumping system to optimize production from the well.

35. A method of optimizing production when an electric submersible pumping system is used as an artificial lift system to produce a fluid, the system having a pump powered by a submersible motor, sensors for measuring production related data, and a processing system for calculating pressure, volume, and temperature (PVT) data according to a desired model, comparing measured PVT data against calculated PVT data, and optimizing production based on discrepancies determined between the measured PVT data and the calculated PVT data, the method comprising:

measuring production related data;

comparing measured (PVT) PVT data against calculated PVT data calculated according to a desired model; and optimizing production based on discrepancies determined between the measured PVT data and the calculated PVT data.

36. The method as recited in claim 35, wherein optimizing production based on discrepancies determined between the measured PVT data and the calculated PVT data comprises changing flow rate by adjusting a valve.

37. The method as recited in claim 35, wherein optimizing production based on discrepancies determined between the measured PVT data and the calculated PVT data comprises changing flow rate by adjusting a choke.

38. The method as recited in claim 35, wherein optimizing production based on discrepancies determined between the measured PVT data and the calculated PVT data comprises changing flow rate by adjusting the frequency of a variable speed drive.

39. The method as recited in claim 35, wherein optimizing production based on discrepancies determined between the measured PVT data and the calculated PVT data comprises changing flow rate by replacing a production related component.

40. The method as recited in claim 35, wherein optimizing production based on discrepancies determined between the measured PVT data and the calculated PVT data comprises changing flow rate by removing a blockage restricting fluid flow.

41. The method as recited in claim 35, wherein optimizing production based on discrepancies determined between the measured PVT data and the calculated PVT data comprises changing flow rate by repairing a fluid leak.

42. The method as recited in claim 35, wherein comparing measured PVT data against calculated PVT data calculated according to a desired model comprises comparing an above the pump gradient.

43. The method as recited in claim 35, wherein comparing measured PVT data against calculated PVT data calculated according to a desired model comprises comparing an across the pump gradient.

44. The method as recited in claim 35, wherein comparing measured PVT data against calculated PVT data calculated according to a desired model comprises comparing a below the pump gradient.

45. The method as recited in claim 35, wherein comparing measured PVT data against calculated PVT data calculated according to a desired model comprises comparing inflow data to outflow data.

* * * * *